US012723801B2

(12) United States Patent
Conte et al.

(10) Patent No.: US 12,723,801 B2
(45) Date of Patent: Sep. 1, 2026

(54) REFRIGERATION APPLIANCE

(71) Applicant: ELECTROLUX APPLIANCES AKTIEBOLAG, Stockholm (SE)

(72) Inventors: Stefano Conte, Porcia (IT); Sergio Grotto, Porcia (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 325 days.

(21) Appl. No.: 18/577,314

(22) PCT Filed: Jun. 15, 2022

(86) PCT No.: PCT/EP2022/066433

§ 371 (c)(1),
(2) Date: Jan. 8, 2024

(87) PCT Pub. No.: WO2023/280543

PCT Pub. Date: Jan. 12, 2023

(65) Prior Publication Data

US 2024/0344756 A1 Oct. 17, 2024

(30) Foreign Application Priority Data

Jul. 9, 2021 (EP) ..... 21184693

(51) Int. Cl.
*F25D 21/14* (2006.01)
*F25D 23/00* (2006.01)

(52) U.S. Cl.
CPC ..... *F25D 21/14* (2013.01); *F25D 23/006* (2013.01); *F25D 2321/143* (2013.01)

(58) Field of Classification Search
CPC ..... F25D 21/14; F25D 2321/144; F25D 2321/1441; F25D 2321/1442; F25D 23/006; F25D 2321/143; F28B 9/08
See application file for complete search history.

(56) References Cited

U.S. PATENT DOCUMENTS 1,951,655 A * 3/1934 Greenwald ..... F25D 19/02 312/351
2,963,882 A * 12/1960 Malkoff ..... F25D 21/14 62/426

(Continued)

FOREIGN PATENT DOCUMENTS

| | | |
|---|---|---|
| DE | 19855504 | 6/2000 |
| NZ | 518556 | 6/2004 |
| WO | 2012072473 | 6/2012 |

OTHER PUBLICATIONS

International Search Report for PCT/EP2022/066433, dated Sep. 16, 2022, 2 pages.

*Primary Examiner* — Tavia Sullens
(74) *Attorney, Agent, or Firm* — Chrisman Gallo Tochtrop LLC

(57) ABSTRACT

A refrigeration appliance (1) including an outer cabinet (2) and inner liner (6) with at least one compartment (10, 12) for storing cooled products and a working chamber (20) configured for receiving at least one component (102) for functioning the appliance (1), wherein a first lateral base support (30) and second lateral base support (32) delimit the working chamber (20). A water collecting tray (50) that delimits the working chamber (20), includes a first end (52) configured connected to the first lateral base support (30) and a second end (54) configured connected to the second lateral base support (32). The appliance (1) includes a centering system (60) that compensates a relative position between the water collecting tray (50) and first lateral base support (30) and/or compensates a relative position between the water collecting tray (50) and second lateral base support (32) along a first direction (DI) and a second direction (D2).

18 Claims, 13 Drawing Sheets

(56) References Cited

U.S. PATENT DOCUMENTS

| | | | | |
|---|---|---|---|---|
| 4,783,971 | A | 11/1988 | Alba | |
| 2009/0056362 | A1 * | 3/2009 | Raab | F25D 21/14<br>62/291 |

* cited by examiner

REFRIGERATION APPLIANCE

FIELD OF THE INVENTION

The present invention relates to a refrigeration appliance, in particular to a refrigeration appliance provided with a working chamber receiving components for the functioning of the appliance.

BACKGROUND ART

Nowadays refrigeration appliances are extensively used, in particular refrigeration appliances for domestic use. We will refer, in particular, to domestic refrigeration appliances comprising one or more compartments, for example fresh food compartments and/or freezer compartments, for the storage of food and/or beverages.

A refrigeration appliance, hereinafter indicated simply with the term refrigerator, typically comprises a parallelepiped-shaped outer cabinet apt to place the refrigerator in a standing working position and an inner liner, disposed within the outer cabinet, which defines said one or more compartments.

The refrigeration is then equipped with a refrigeration system apt to cool the compartments and preferably comprises an electric motor-driven compressor, a condenser heat exchanger, a capillary tube, an evaporator and a fan for creating a cooling air stream for the compartment/s.

The condenser heat exchanger is preferably constituted of a condenser tubing that preferably has a serpentine configuration and is preferably externally secured to the rear side wall of the outer cabinet so as to form what is commonly known as a "hot wall".

Part of the components of the refrigeration system are preferably arranged in a proper chamber of the refrigerator, or working chamber. The working chamber and components contained therein, for example the compressor and the capillary tube, are preferably arranged on the bottom of the cabinet at its back side.

The working chamber is typically defined by lateral sides that laterally delimit the working chamber itself.

In solutions of known type, at the top of the working chamber there is provided a water collecting tray that is opportunely arranged to receive condensed water falling from the condenser tubing.

The realization of the working chamber requires several components, such as pleated sheet metals, brackets, insulating materials, that firstly implies several manufacturing steps for assembling the components in the correct reciprocal position.

Positioning and fixing of the water collecting tray above the working chamber have a relevant impact on the manufacturing steps in terms of number of components required and/or complicated components management and/or handling difficulty of the components.

Reliable fixing of the water collecting tray is affected by tolerances in the component parts and particular attention has to be paid to precisely assembling the parts one to the other. This firstly negatively affects time and costs during manufacturing.

Furthermore, tolerances may negatively affect stability of the connection between the component parts. Unwanted vibrations and/or noise may also consequently arise, mainly due to movement caused by the compressor during normal working conditions.

One object of the present invention is therefore to overcome the limits posed by the known techniques.

It is an object of the invention to provide a refrigeration appliance that increases reliability compared to known refrigeration appliances.

It is another object of the invention to provide a refrigeration appliance that reduces unwanted vibrations and/or noise compared to known refrigeration appliances.

It is a further object of the invention to provide a refrigeration appliance that optimizes assembling operations compared to known techniques.

It is another object of the invention to provide a refrigeration appliance that simplify the manufacturing process in terms of needed components.

DISCLOSURE OF INVENTION

The applicant has found that by providing a refrigeration appliance having an outer cabinet, a working chamber apt to receive at least one component for the functioning of appliance, two base supports at least partially laterally delimiting said working chamber and a water collecting tray apt to be connected to said base supports, wherein the appliance comprises a centering system acting to compensate the relative position between said water collecting tray and said base supports along both a first direction and a second direction, it is possible to increase reliability of the appliance.

According to one aspect of the present disclosure there is provided a refrigeration appliance comprising:

- an outer cabinet and an inner liner, internal to said outer cabinet, defining at least one compartment for the storage of products to be cooled;
- a working chamber apt to receive at least one component for the functioning of said appliance;
- a first lateral base support and a second lateral base support facing said first lateral base support, said base supports at least partially laterally delimiting said working chamber;
- a water collecting tray at least partially delimiting said working chamber from above, said water collecting tray comprising a first end apt to be connected to said first lateral base support and a second end apt to be connected to said second lateral base support;

wherein it comprises a centering system acting to compensate the relative position between said water collecting tray and said first lateral base support and/or to compensate the relative position between said water collecting tray and said second lateral base support along both a first direction and a second direction.

Advantageously, by providing said centering system it is possible to adapt the position of the water collecting tray with respect to the first and/or the second base support caused by tolerances along said two directions.

Preferably, the first direction is perpendicular to the second direction.

In a preferred embodiment, the first direction is the horizontal direction and the second direction is the vertical direction when the appliance is in its standing working position.

According to a preferred embodiment of the invention, the water collecting tray is removably connected to the first lateral base support and the second lateral base support.

Preferably, the centering system comprises:

- a first centering device arranged between the first end of the water collecting tray and the first lateral base support, the first centering device acting to compensate the relative position between the water collecting tray and the first lateral base support and/or to compensate the relative position between the water collecting tray and the second lateral base support along both the first direction and the second direction; and/or a second centering device arranged between the second end of the water collecting tray and the second lateral base support, said second centering device acting to compensate the relative position between the water collecting tray and the second lateral base support and/or to compensate the relative position between the water collecting tray and the first lateral base support along both the first direction and the second direction.

In a preferred embodiment, the first centering device comprises:

at least one first flexible element realized in the first end of the water collecting tray apt to abut against a respective first retaining surface of the first lateral base support to exert a compensating force along the first direction or at least one first flexible element realized in the first lateral base support apt to abut against a respective first retaining surface of the first end of the water collecting tray to exert a compensating force along the first direction; and at least one second flexible element realized in the first end of the water collecting tray apt to abut against a respective second retaining surface of the first lateral base support to exert a compensating force along the second direction or at least one second flexible element realized in the first lateral base support apt to abut against a respective second retaining surface of the first end of the water collecting tray to exert a compensating force along the second direction.

According to a preferred embodiment of the invention, the second centering device comprises:

at least one first flexible element realized in the second end of the water collecting tray apt to abut against a respective first retaining surface of the second lateral base support to exert a compensating force along the first direction or at least one first flexible element realized in the second lateral base support apt to abut against a respective first retaining surface of the second end of the water collecting tray to exert a compensating force along the first direction; and at least one second flexible element realized in the second end of the water collecting tray apt to abut against a respective second retaining surface of the second lateral base support to exert a compensating force along the second direction or at least one second flexible element realized in the second lateral base support apt to abut against a respective second retaining surface of the second end of the water collecting tray to exert a compensating force along the second direction.

In a further preferred embodiment, the centering system comprises:

a first centering device arranged between the first end of the water collecting tray and the first lateral base support, the first centering device acting to compensate the relative position between the water collecting tray and the first lateral base support and/or to compensate the relative position between the water collecting tray and the second lateral base support along a first direction; and a second centering device arranged between the second end of the water collecting tray and the second lateral base support, second centering device acting to compensate the relative position between the water collecting tray and the second lateral base support and/or to compensate the relative position between the water collecting tray and the first lateral base support along the second direction.

Preferably, the first centering device comprises:

at least one first flexible element realized in the first end of the water collecting tray apt to abut against a respective first retaining surface of the first lateral base support to exert a compensating force along the first direction or at least one first flexible element realized in the first lateral base support apt to abut against a respective first retaining surface of the first end of the water collecting tray to exert a compensating force along the first direction; and wherein the second centering device comprises:

at least one second flexible element realized in the second end of the water collecting tray apt to abut against a respective second retaining surface of the second lateral base support to exert a compensating force along the second direction or at least one second flexible element realized in the second lateral base support apt to abut against a respective second retaining surface of the second end of the water collecting tray to exert a compensating force along the second direction.

In a preferred embodiment, the appliance further comprises a first removably fixing device for removably fixing the first end of the water collecting tray to the first lateral base support and/or a second removably fixing device for removably fixing the second end of the water collecting tray to the second lateral base support.

Advantageously, easy removal of the water collecting tray is obtained.

According to a preferred embodiment of the invention, water collecting tray comprises a water collecting area, opening upwards, defined between first end and the second end apt to collect condensed water generated during functioning of the appliance.

Preferably, the appliance comprises an evaporator device associated to the water collecting area, the evaporator device comprising a heater tube for water evaporation and at least one mounting device to maintain the heater tube inside the water collecting area.

In a preferred embodiment, the mounting device comprises a receiving seat realized in the water collecting area and a clip apt to surround the heater tube and apt to be inserted into the receiving seat.

Advantageously, assembling operations of the heater tube are simplified during manufacturing process.

According to a preferred embodiment of the invention, the appliance comprises a cross bar connecting the first lateral base support to the second lateral base support.

Preferably, the first lateral base support and/or the second lateral base support comprises means for the connection to the cross bar, wherein the means preferably comprise a protrusion extending from the first lateral base support and/or the second lateral base support apt to be connected to an extremity of the cross bar.

Advantageously, stability and stiffness of the base supports are improved.

In a preferred embodiment, the appliance comprises a supporting element for the at least one component, preferably a compressor, arranged in the lower part of the working chamber, wherein the first lateral base support and the second lateral base support comprises at least one slit apt to slidingly receive the supporting element.

According to a preferred embodiment of the invention, the first lateral base support comprises two or more slits arranged one above the other and the second lateral base support comprises two or more slits arranged one above the other so that the supporting element may be slidingly received at different position.

Advantageously, the supporting element may be arranged in the most proper position according to dimensions of component mounted thereto, in particular according to dimensions of the compressor.

Preferably, the working chamber is arranged on the back side of the appliance. This is the usual position of the working chamber for a refrigeration appliance being said chamber hidden from the user. Furthermore, said position improves the sound damping as well as the heat dissipation of components generating heat inside the working chamber, such as the compressor and/or electronic devices.

BRIEF DESCRIPTION OF THE DRAWINGS

Further characteristics and advantages of the present invention will be highlighted in greater detail in the following detailed description of a preferred embodiment of the invention, provided with reference to the enclosed drawings.

In such drawings.

DETAILED DESCRIPTION OF A PREFERRED EMBODIMENT OF THE INVENTION

The refrigeration appliance according to the present invention has proved to be particularly advantageous when refers to a refrigeration appliance for domestic use. It should in any case be underlined that the present invention is not limited to this particular embodiment. On the contrary, the present invention conveniently refers to any refrigeration appliance being provided with a working chamber wherein components for the functioning of the refrigeration appliance are arranged.

Figure 1:
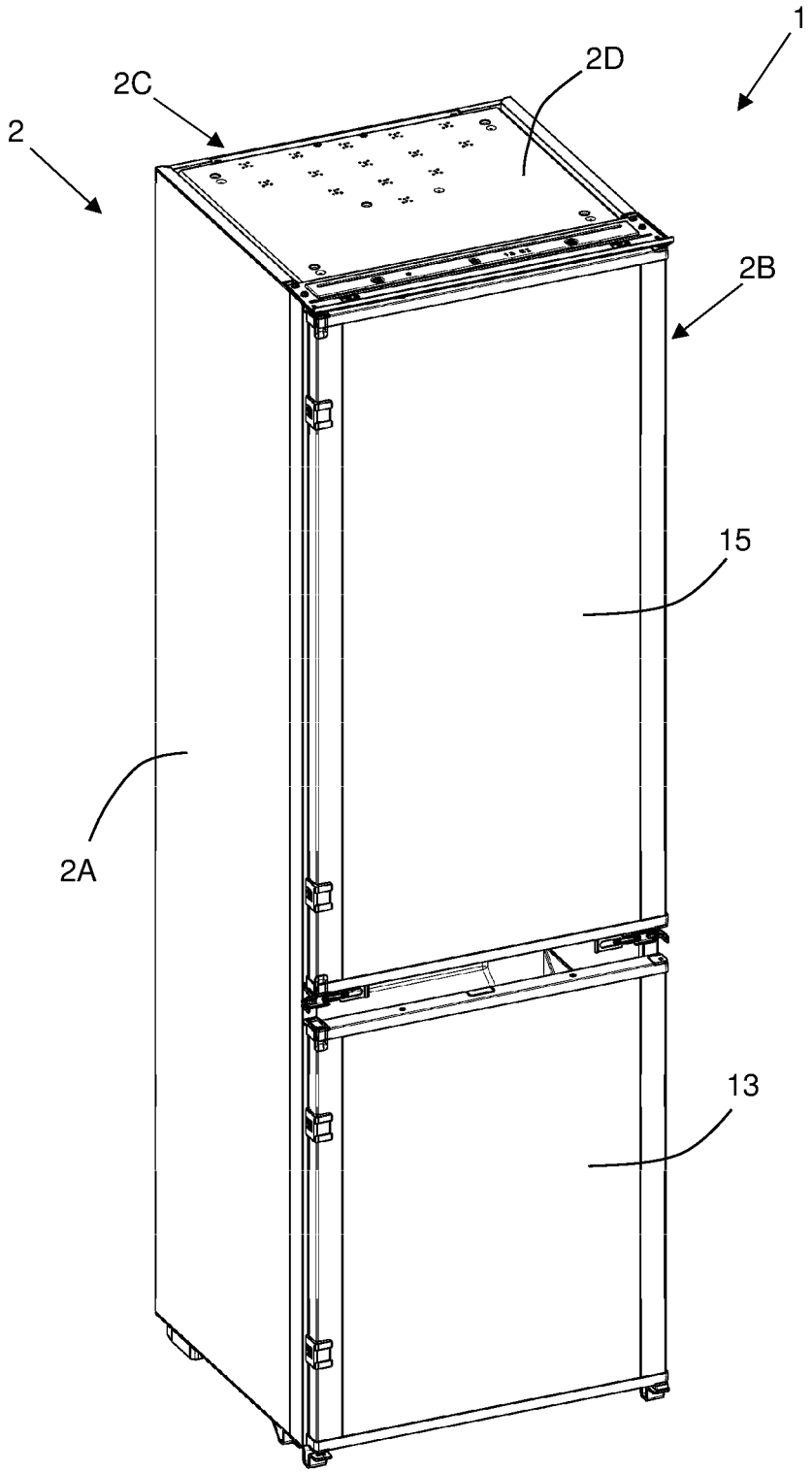
FIG. 1 shows a front perspective view of a refrigeration appliance according to a preferred embodiment of the invention.
Figure 2:
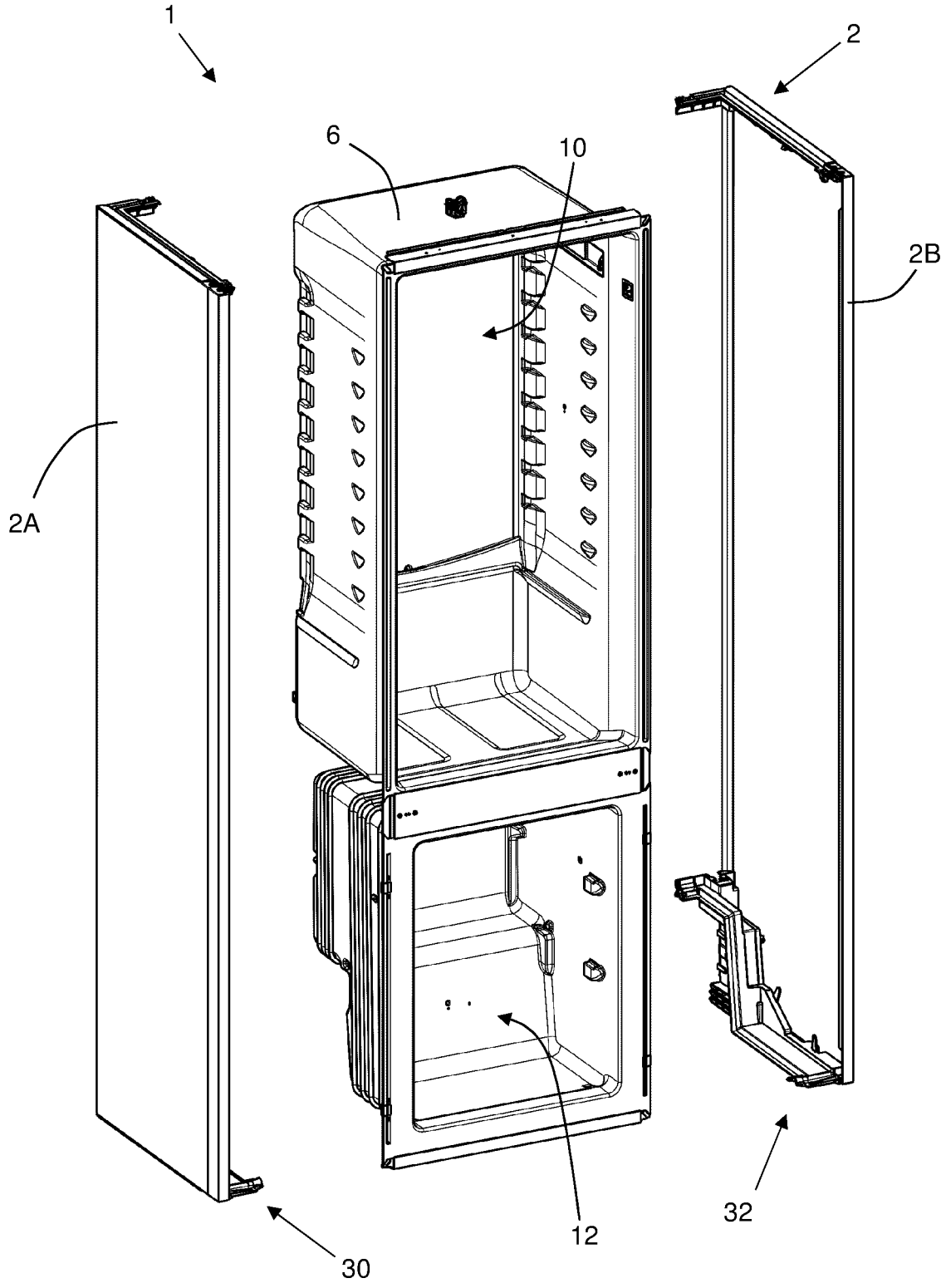
FIG. 2 shows an exploded view of FIG. 1.

Referring to FIGS. 1 and 2 a refrigeration appliance, or refrigerator, in the form of a domestic refrigerator is shown, indicated generally as 1. Although the detailed description that follows concerns a domestic stand-alone refrigerator 1, the refrigeration appliance can be embodied by refrigeration appliances other than a domestic refrigerator.

Furthermore, the embodiment described in detail below refers to a bottom mount refrigerator, i.e. of the type including a freezer compartment disposed vertically below a fresh food compartment. However, the refrigerator according to the invention can have any desired configuration, for example a top mount refrigerator wherein the freezer compartment is disposed vertically above the fresh food compartment or a refrigerator comprising only a fresh food compartment or only a freezer compartment.

Furthermore, while the present application is described with reference to a stand-alone refrigerator it has to be noted that also a built-in solution may be contemplated.

The refrigerator 1 preferably comprises a freezer compartment 12 disposed vertically below a fresh food compartment 10, as visible in FIG. 2.

A refrigeration system 100 is preferably provided to cool the compartments 10, 12, more preferably the refrigeration system is apt to cool down air which is circulated inside the compartments 10, 12.

The refrigeration system 100 preferably comprises components configured to generate said cooling air flow. The refrigeration system 100 preferably comprises a closed recirculating system filled with a suitable refrigerant, for example R12 or R134a. The refrigeration system 100 preferably comprises an electric motor-driven compressor 102, a condenser heat exchanger 104, a pressure device such as a capillary tube or a thermostatic valve and an evaporator, which eventually define said components (some of said components visible in the figures). A fan is also preferably used to circulate the cooled air inside the compartments 10, 12.

Figure 3:
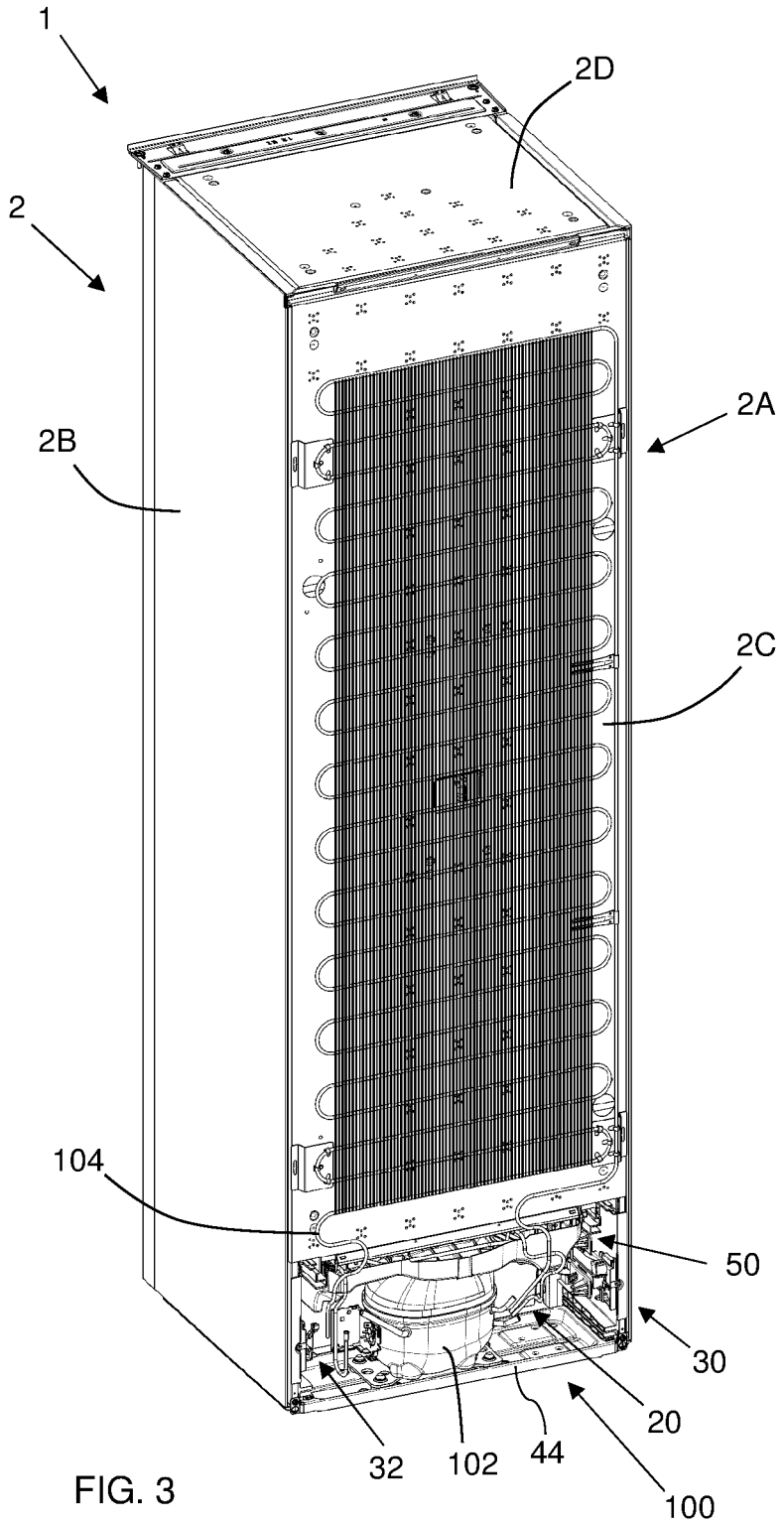
FIG. 3 shows a rear perspective view of the appliance of FIG. 1.

The condenser heat exchanger 104 preferably comprises a condenser tubing that preferably has a serpentine configuration and is preferably externally secured to the rear side wall 2C of the outer cabinet 2 so as to form what is commonly known as a "hot wall", as shown in FIG. 3.

The refrigerator 1 preferably comprises an outer cabinet 2 and an inner liner 6, internally received in the outer cabinet 2. The inner liner 6 preferably defines said fresh food compartment 10 and said freezer compartment 12.

A door 15 is preferably pivotally mounted to the outer cabinet 2 and is movable between an open position and a closed position to cover the fresh food compartment 10 and a door 13 is preferably pivotally mounted to the outer cabinet 2 and is movable between an open position and a closed position to cover the freezer compartment 12. The compartments 10, 12 are preferably provided with support shelves and/or drawers (not shown).

In the preferred embodiment illustrated and described hereinbelow, the compartments 10, 12 are defined by the inner liner 6 preferably formed as a one-piece monolithic body.

In different preferred embodiments, the compartments 10, 12 may be defined by respective separated inner liners.

The inner liner 6 is preferably made of a polymeric plastic material, such as PS (polystyrene).

According to this preferred embodiment, the compartments 10, 12 have a substantially parallelepiped shape.

The outer cabinet 2 is preferably parallelepiped-shaped and preferably comprises side walls 2A, 2B, 2C, 2D, preferably two lateral side walls 2A, 2B, a rear side wall 2C and a top side wall 2D.

In its standing working position, lateral side walls 2A, 2B and the rear side wall 2C are preferably aligned to a vertical direction.

The lateral side walls 2A, 2B (left side wall 2A and right side wall 2B) preferably extend from the front side to the rear side of the refrigerator 1.

Some of said components of the refrigeration system 100 are preferably arranged in a working chamber 20 of the refrigerator 1.

The working chamber 20 is preferably arranged at the back side of the refrigerator 1 and preferably at a bottom part of the rear side wall 2C.

This is the usual position of the working chamber 20 for a refrigeration appliance being said chamber 20 hidden from the user. Furthermore, said position improves the sound damping as well as the heat dissipation of components generating heat inside the working chamber 20, such as the compressor 102 and/or electronic devices.

Figure 4:
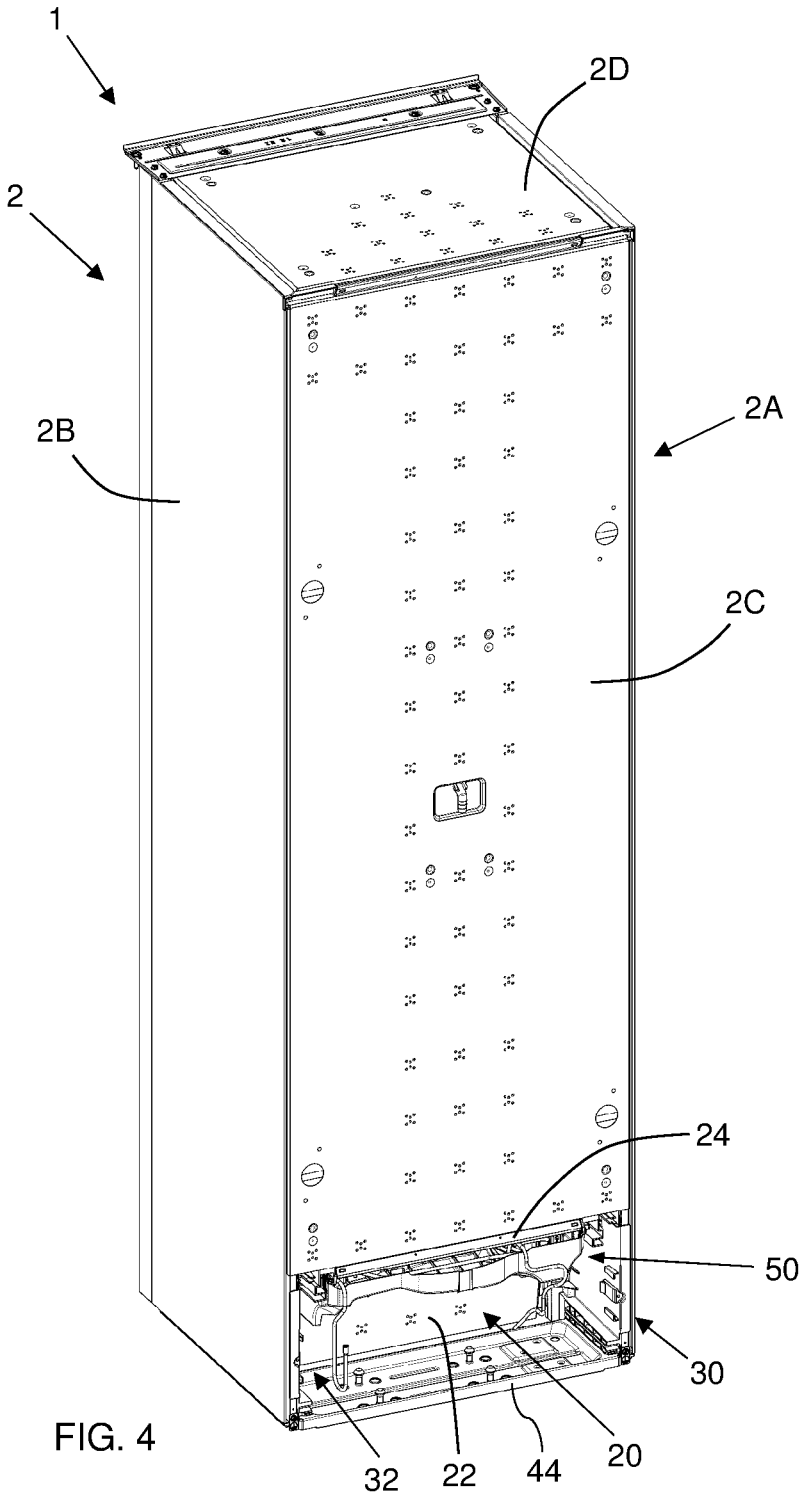
FIG. 4 shows the appliance of FIG. 3 with some components removed therefrom.

The working chamber 20 is preferably thermally-insulated and/or sound-insulated, in particular thermally-insulated with respect to the freezer compartment 12. A shaped panel 22 is preferably interposed between the working chamber 20 and the freezer compartment 12, as depicted in FIG. 4.

The refrigerator 1 then preferably comprises a first lateral base support 30 and a second lateral base support 32 arranged at its lower side.

The two base supports 30, 32 faces each other and are preferably aligned with respective lateral side walls 2A, 2B. More preferably, the first base support 30, or left support 30, is aligned to, and substantially arranged below, the left side wall 2A and the second base support 32, or right support 32, is aligned to, and substantially arranged below, the right side wall 2B. The two base supports 30, 32 are preferably fixedly connected to respective lateral side walls 2A, 2B.

The base supports 30, 32 advantageously support the refrigerator 1 when the latest is positioned in its standing working position.

Preferably, the base supports 30, 32 at least partially delimit the working chamber 20; more preferably the two base supports 30, 32 at least partially laterally delimit the working chamber 20.

The two base supports 30, 32 together with the shaped panel 22 eventually delimit the working chamber 20 and the working chamber 20 is preferably open towards the outside so that it can be conveniently accessible in case of maintenance. Furthermore, dissipation of heat produced by components inside the working chamber 20 is enhanced, in particular heat produced by the compressor 102.

The working chamber 20 is then preferably delimited by the shaped panel 22 in the back-to-front direction while the working chamber 20 is preferably open towards the outside.

Preferably, the base support 30, 32 comprises a single body extending from the front side to the rear side of the refrigerator 1. Preferably, the base support 30, 32 is constituted of a plastic single body, more preferably is moulded via an injection moulding process. Preferably, the base support 30, 32 is made of flame retardant material, for example Polypropylene 5VA.

Preferably, the first/left base support 30 extends, together with the first/left side wall 2A, from the front side to the rear side of the refrigerator 1 and, analogously, the second/right base support 32 extends, together with the second/right side wall 2B, from the front side to the rear side of the refrigerator 1. The side wall 2A, 2B laterally entirely covers the base support 30, 32 or, in other words, no one surface of the base support 30, 32 is exposed directly to the outside. Advantageously, such a solution allows to improve the aesthetic appearance of the refrigerator 1.

In a further preferred embodiment, not shown, the side wall laterally partially covers the base support or, in other words, a lower part of the base support is not covered by the side wall and is exposed directly to the outside.

Figure 5:
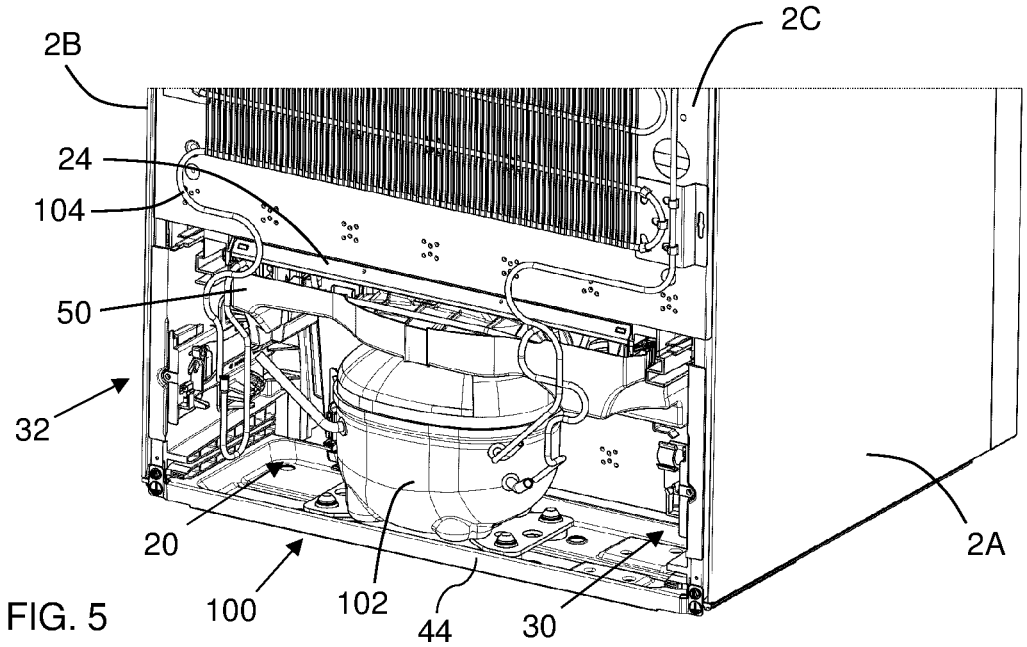
FIG. 5 shows an enlarged detail of FIG. 3.

A cross bar 24, then, preferably connects the two base supports 30, 32 (FIGS. 4 and 5). In the preferred embodiment illustrated in the figures, the cross bar 24 is preferably arranged at the rear side of the base supports 30, 32, above the working chamber 20, and transversally connects the same. The cross bar 24 is preferably connected with screws to the base supports 30, 32.

Figure 10:
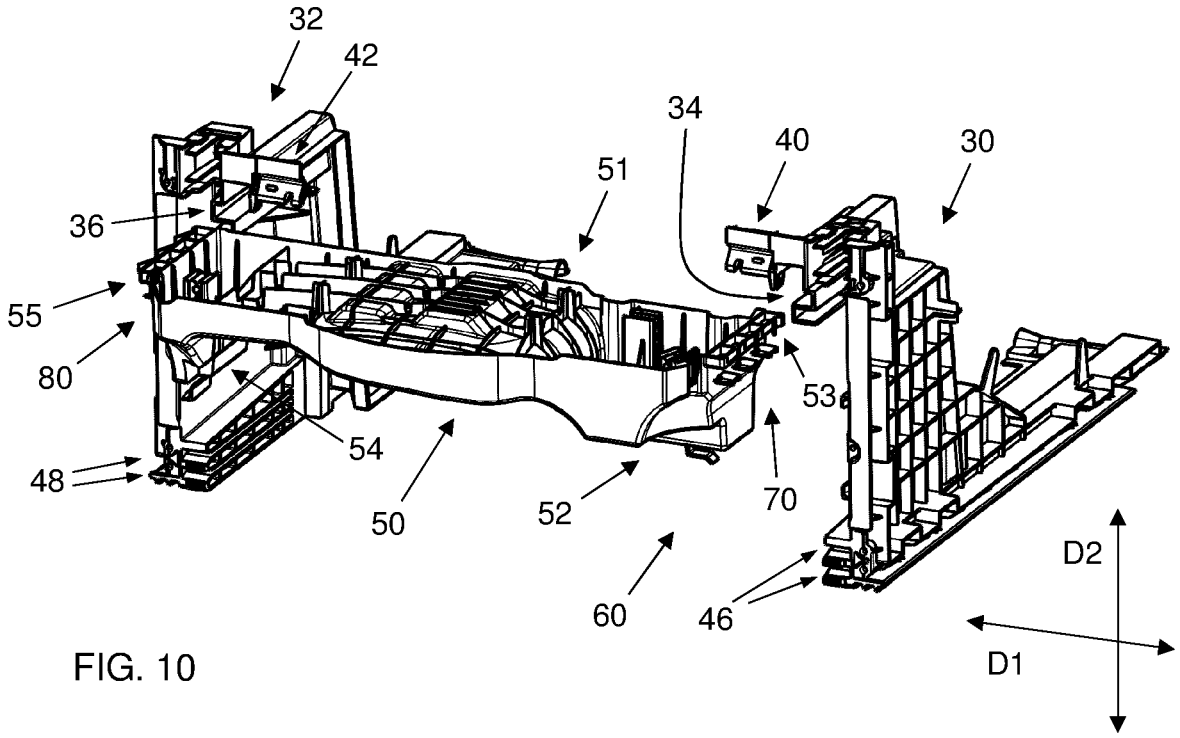
FIG. 10 shows a partial exploded view of FIG. 9.

More preferably, the extremities of the cross bar 24 are preferably connected to the base supports 30, 32 at respective protrusions 40, 42, visible in FIG. 10, inwardly extending from the base supports 30, 32.

The cross bar 24 advantageously improves stability and stiffness of base supports 30, 32.

Furthermore, the base supports 30, 32 are opportunely configured to receive a supporting element 44 which is preferably arranged in the lower part of the working chamber 20, preferably to support components inside the working chamber 20. More preferably the supporting element 44 supports the compressor 102 which is preferably fixed with screws to the supporting element 44.

The supporting element 44 is preferably removably associated to the base supports 30, 32, as better described later.

According to an aspect of the invention, a water collecting tray 50 is associated to the working chamber 20 and at least partially delimits the working chamber 20 from above. The water collecting tray 50, hereinafter simply indicated also as tray, is opportunely arranged to receive condensed water which is created at the evaporator in normal working condition of the refrigerator 1.

The evaporator (not shown), in fact, is preferably arranged between the rear side of the inner liner 6 and the rear side wall 2C of the outer cabinet and above the working chamber.

Preferably, the condensed water created by the evaporator is preliminarily collected in a further collecting evaporator tray (not shown) arranged above water collecting tray 50.

The main function of the tray 50 is to protect the components of the refrigeration system 100 arranged in the working chamber 20, for example the compressor 102 and/or electronic components, from condensed water created by the evaporator.

Water is advantageously collected in the tray 50 and, preferably, an evaporator device 120 is associated to the tray 50 to enhance evaporation of the water collected therein, as better described later.

The tray 50 preferably comprises a first end 52 apt to be connected to the first base support 30 and a second end 54 apt to be connected to the second base support 32.

The tray 50 preferably comprises a water collecting area 51, opening upwards, defined between first end 52 and said second 54 to collect condensed water.

According to an aspect of the invention, a centering system 60 is preferably provided to compensate the relative position between the tray 50 and the first base support 30 and/or to compensate the relative position between the tray 50 and the second base support 32.

With "compensate" is meant the function of adapting or adjusting the position of the tray 50 with respect to the first base support 30 and/or the second base support 32 caused by tolerances.

According to a further aspect of the invention, the centering system 60 is preferably provided to compensate the relative position between the tray 50 and the first base support 30 and/or to compensate the relative position between the tray 50 and the second base support 32 along both a first direction D1 and a second direction D2.

According to the preferred embodiment illustrated ad described herein, the first direction D1 is perpendicular to the second direction D2. Preferably, the first direction D1 corresponds to the horizontal direction and the second direction D2 corresponds to the vertical direction when the refrigerator 1 is in its standing working position.

In different embodiments, compensation directions D1 and D2 may be inclined one to the other, hence not necessarily perpendicular one to the other.

The tray 50 is preferably connected to the first lateral base support 30 and the second lateral base support 32 in a removable way.

At this purpose, the first base support 30 preferably comprises a first sliding guide 34 and the first end 52 of the tray 50 comprises a corresponding first tab 53 apt to slide along the first sliding guide 34.

Analogously, the second base support 32 preferably comprises a second sliding guide 36 and the second end 54 of the tray 50 comprises a corresponding second tab 55 apt to slide along the second sliding guide 36.

First and second sliding guides 34, 36 preferably comprise respective U-shaped channels.

Figure 9:
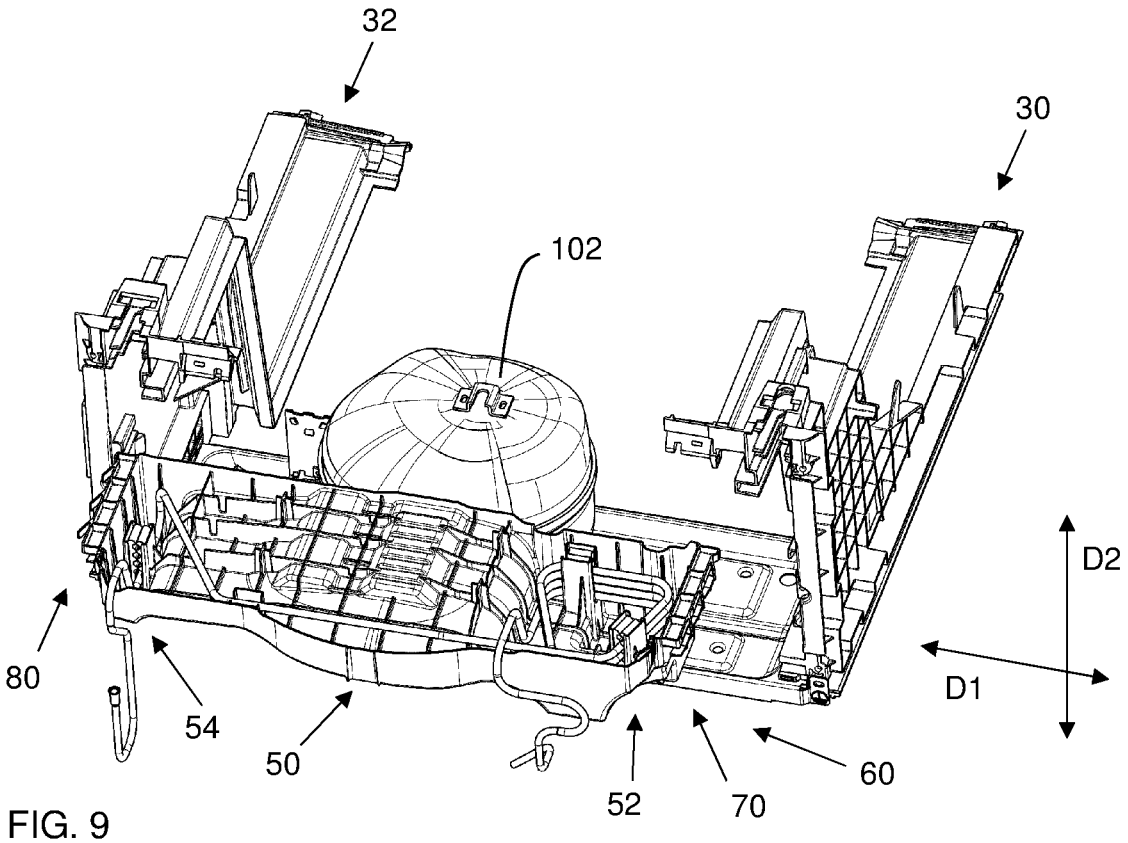
FIG. 9 shows elements of FIG. 5 isolated from the rest.

The tray 50 may thus be easily arranged over the working chamber 20 by pushing it towards its final or working position, for example the position shown in FIG. 9, and may be easily removed from the working chamber 20 by pulling it outwardly.

The centering system 60 preferably comprises a first centering device 70 arranged between the first end 52 of the tray 50 and the first base support 30 and a second centering device 80 arranged between the second end 54 of the tray 50 and the second base support 32.

The first centering device 70 acts to compensate the relative position between the tray 50 and the first base support 30 along said directions D1, D2 and the second centering device 80 acts to compensate the relative position between the tray 50 and the second base support 32 along said directions D1, D2.

Figure 11:
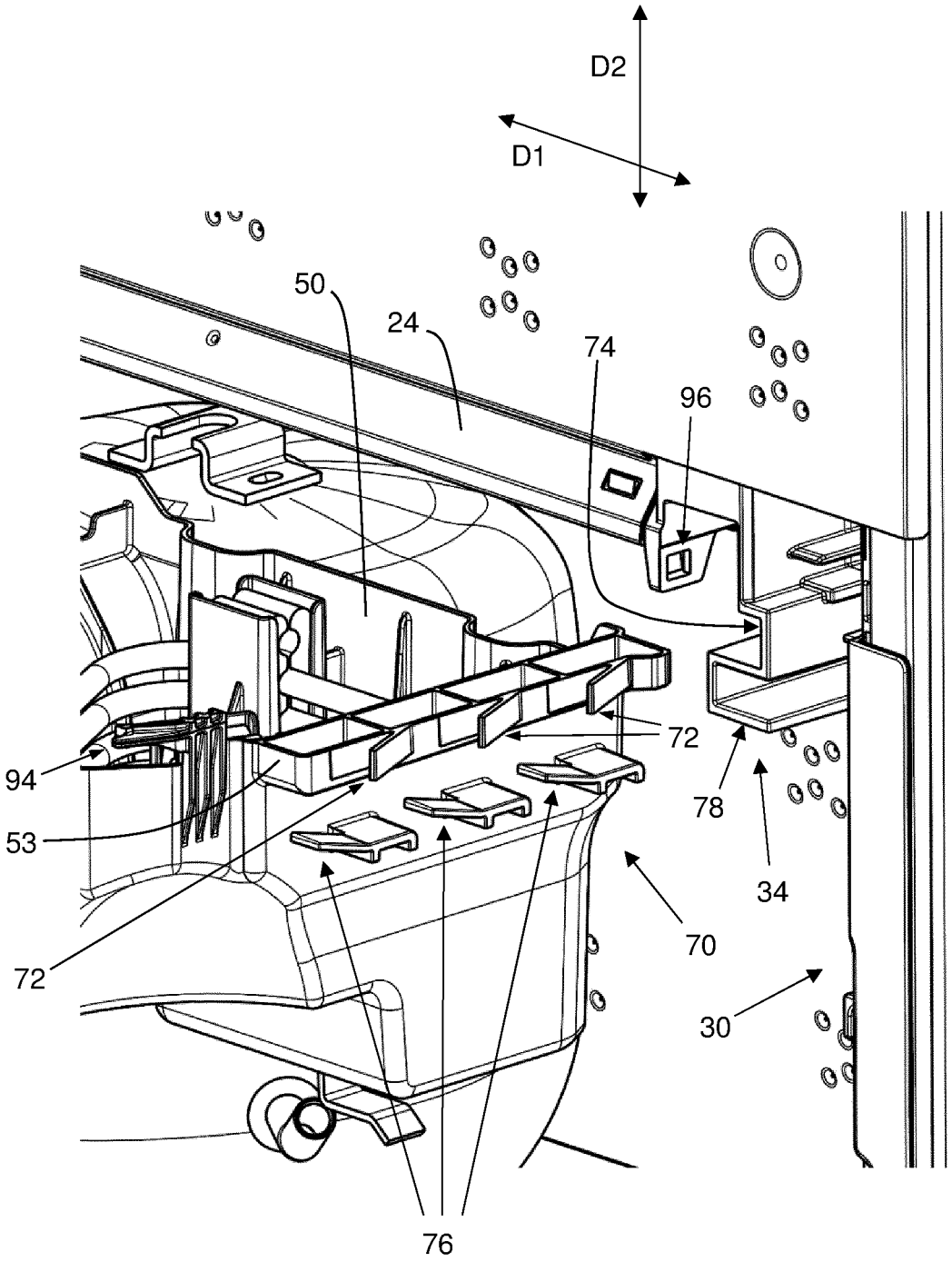
FIG. 11 shows an enlarged detail of FIG. 10.
Figure 12:
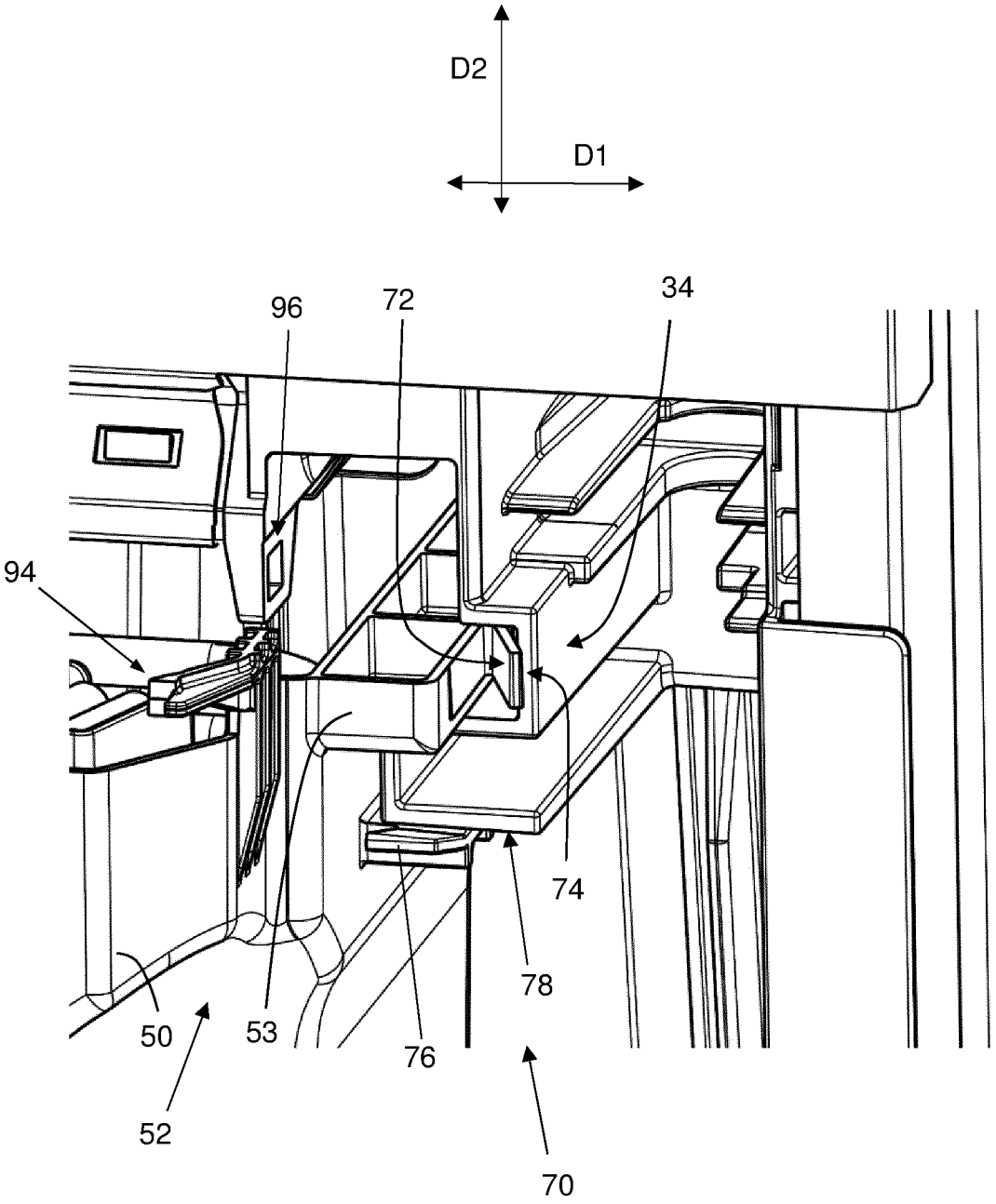
FIG. 12 shows the detail of FIG. 11 in a further operative position.

The first centering device 70, as shown in FIGS. 11 and 12, preferably comprises at least one first flexible element 72 realized in the first end 52 of the tray 50 apt to abut against a respective first retaining surface 74 of the first base support 30. More preferably the at least one first flexible element 72 is realized in the first tab 53 of first end 52 of the tray 50 and the first retaining surface 74 is defined by a vertical surface of the first sliding guide 34.

According to the preferred embodiment illustrated herein, there are preferably provided three flexible elements 72 arranged one after the other.

Each first flexible element 72 preferably extends along the first direction D1 and thanks to its flexibility it exerts a pushing force against the first retaining surface 74. Said pushing force compensates the relative position between the tray 50 and the first base support 30 along the first direction D1 or, in other words, adapts the position of the tray 50 with respect to the first base support 30 caused by tolerances along the first direction D1.

The first centering device 70 then preferably comprises at least one second flexible element 76 realized in the first end 52 of the tray 50 apt to abut against a respective second retaining surface 78 of the first base support 30. More preferably the at least one second flexible element 76 is realized in a protrusion of first end 52 of the tray 50 and the second retaining surface 78 is defined by a horizontal surface of the first base support 30.

According to the preferred embodiment illustrated herein, there are preferably provided three flexible elements 76 arranged one after the other.

Each second flexible element 76 preferably extends along the second direction D2 and thanks to its flexibility it exerts a pushing force against the second retaining surface 78. Said pushing force compensates the relative position between the tray 50 and the first base support 30 along the second direction D2 or, in other words, adapts the position of the tray 50 with respect to the first base support 30 caused by tolerances along the second direction D2.

According to the preferred embodiment illustrated and described herein, therefore, first and second flexible elements 72, 76 are preferably associated to the tray 50 and the corresponding first and second retaining surfaces 74, 78 are associated to the first base support 30.

In further preferred embodiments, nevertheless, the first and/or the second flexible elements may be associated to the first base support and the corresponding first and/or second retaining surfaces may be associated to the first base support.

As said above, the second centering device 80 acts to compensate the relative position between the tray 50 and the second base support 32.

The second centering device 80 is realized substantially and symmetrically as the first centering device 70 and therefore non illustrated and described in detail. Advantageously, the centering system 60 of the invention allows compensation of the relative position between the tray 50 and the first base support 30 and/or between the tray 50 and the second base support 32 along said two directions D1, D2.

Still advantageously, the connection between the tray 50 and the first base support 30 and/or the second base support 32 is stable and vibrations between the parts are avoided. Reliability is thus increased, and noise is also advantageously reduced/eliminated compared to known systems.

According to the preferred embodiment illustrated and as described above, the centering system 60 preferably comprises two centering devices 70, 80. In a further preferred embodiment, nevertheless, the centering system may comprises only one between said two centering device.

Furthermore, according to the preferred embodiment illustrated and described herein, each centering device 70, 80 individually compensates the relative position between the tray and one of the base support along two directions D1, D2.

In further preferred embodiments, nevertheless, the first centering device may be configured to compensate the relative position between the tray and one of the base supports along a first direction and the second centering device may be configured to compensate the relative position between the tray and one of the base supports along a second direction.

According to another aspect of the invention, there is provided at least one removably fixing device 90, 92 for removably fixing the tray 50 to the first base support 30 and/or to the second base support 32.

Preferably, there is provided a first removably fixing device 90 for removably fixing the first end 52 of the tray 50 to the first base support 30 and a second removably fixing device 92 for removably fixing the second end 54 of the tray 50 to the second base support 32.

Figure 13:
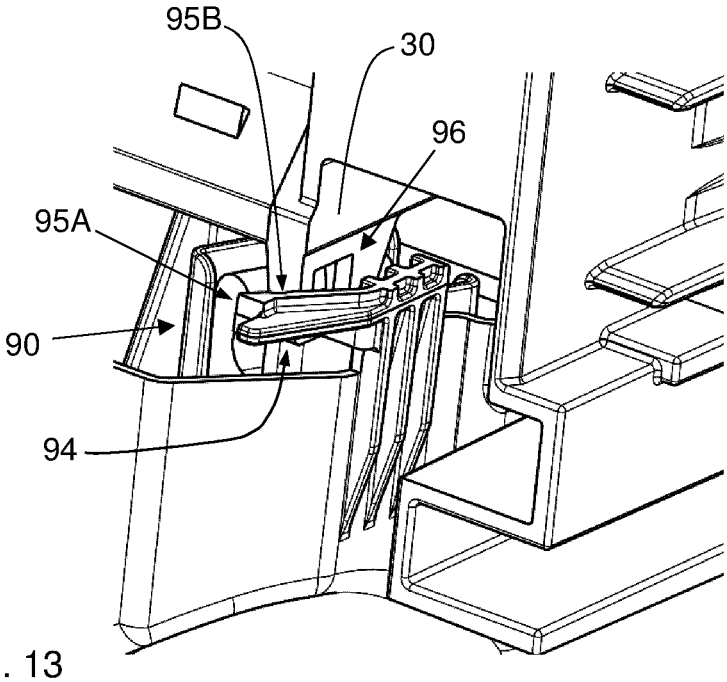
FIGS. 13 and 14 show a detail of FIG. 10 in different operative positions.
Figure 14:
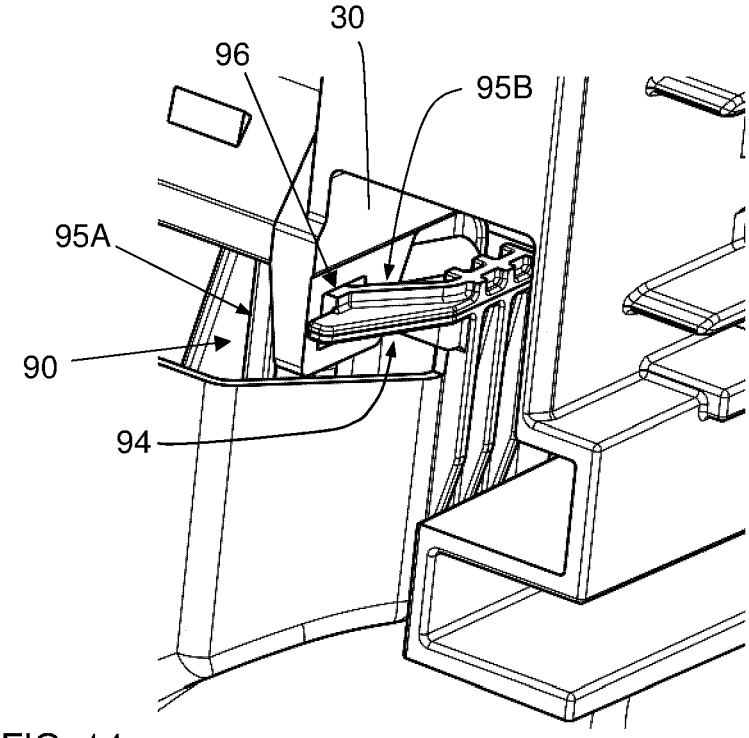

As illustrated in FIGS. 13 and 14, the removably fixing device 90, 92 has the function of keeping the tray 50 in its final or working position and allows easy removal of the tray 50 by extracting it outwardly.

The first removably fixing device 90 preferably comprises an elastic tab 94 arranged at said tray 50 and a retaining seat 96 arranged at said first base support 30. The elastic tab 94 comprises a blocking portion 95A which is configured to engage the retaining seat 96 when the tray 50 is brought in its final position, as illustrated in FIG. 14. A sliding surface 95B of the elastic tab 94 allows deformation of the elastic tab 94 while the tray 50 is pushed towards its final position.

Removal of the tray 50 from its final position is simply carried out by disengaging/extracting the blocking portion 95A of the elastic tab 94 from the seat 96 and moving the tray 50 outwardly.

The second removably fixing device 92 is realized substantially and symmetrically as the first removably fixing device 90 and therefore non illustrated and described in detail.

According to the preferred embodiment illustrated and as described above, therefore, the removably fixing device preferably comprises two removably fixing device 90, 92. In a further preferred embodiment, nevertheless, only one between said two removably fixing device may be contemplated.

Furthermore, according to the preferred embodiment illustrated and described herein, the elastic tab 94 is preferably associated to the tray 50 and the corresponding retaining seat 96 is associated to the first base support 30.

In further preferred embodiments, nevertheless, the elastic tab may be associated to the first base support and the corresponding retaining seat may be associated to the tray.

Figure 15:
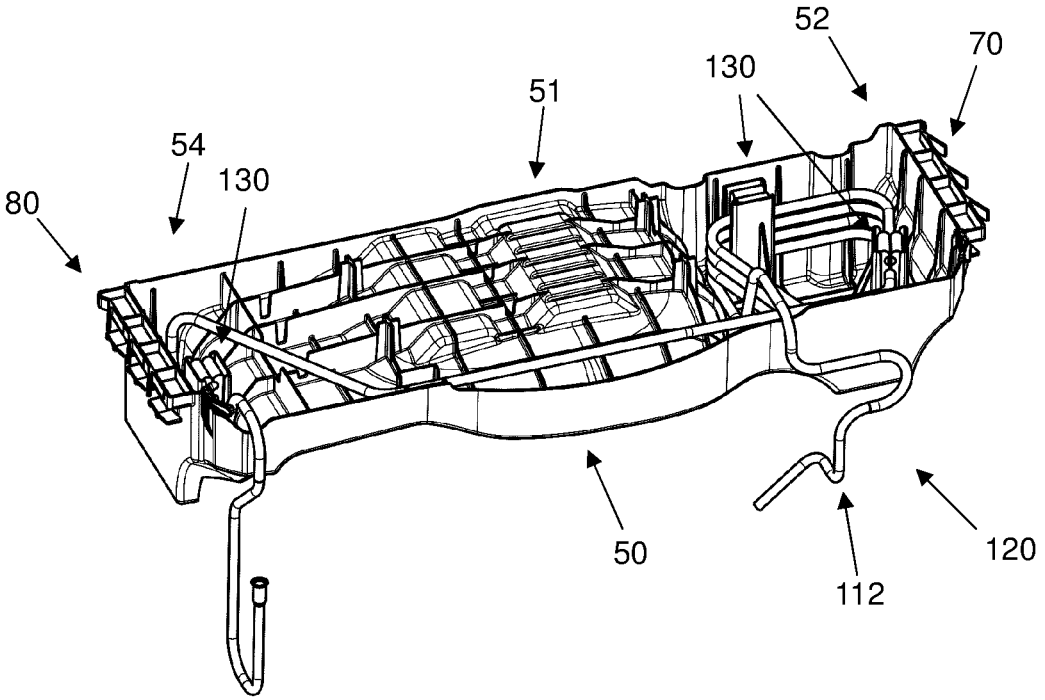
FIG. 15 shows elements of FIG. 5 isolated from the rest.
Figure 16:
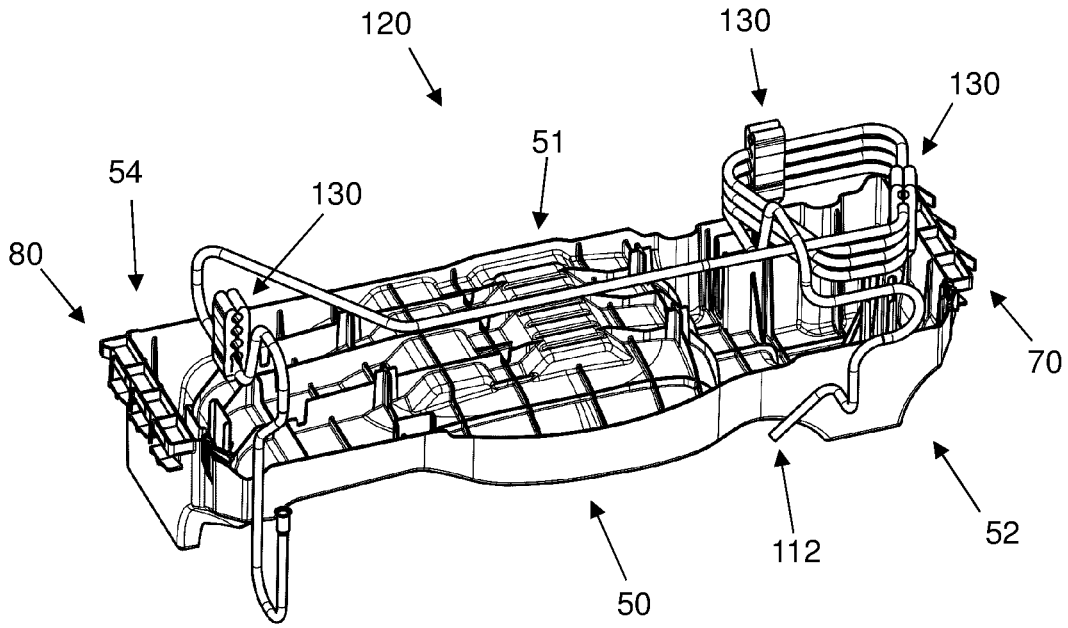
FIGS. 16 and 17 show two exploded views of FIG. 15.
Figure 17:
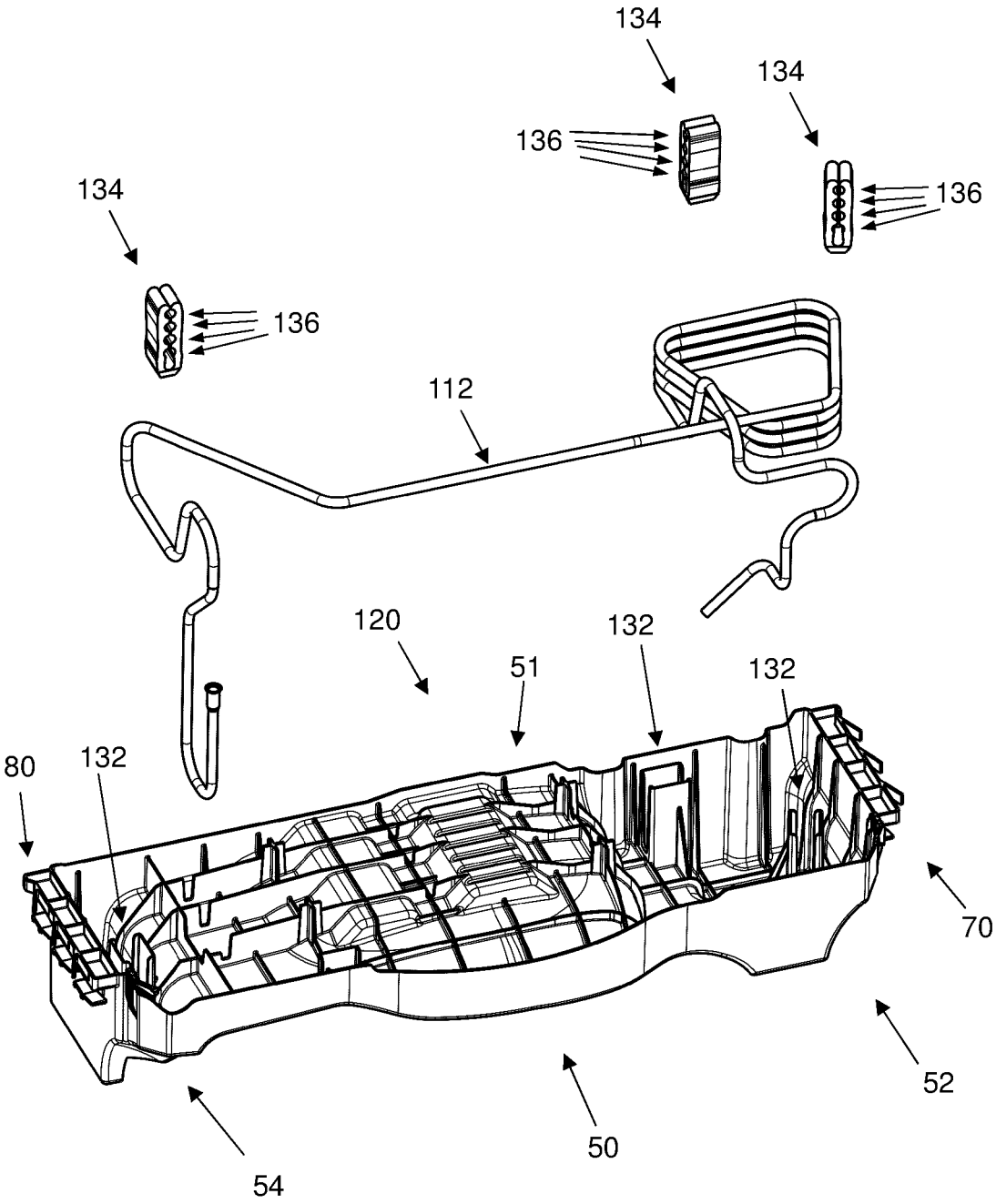

According to a further aspect of the invention, an evaporator device 120 is associated to the tray 50 to enhance evaporation of the water collected therein, as mentioned above and as illustrated in FIGS. 15 to 17.

The evaporator device 120 preferably comprises a heater tube 112 which is arranged inside the water collecting area 51 of the tray 50. The heater tube 112, according to known techniques, is preferably part of the refrigeration system 100 and is more preferably realized through a branch of the condenser heat exchanger 104.

In further preferred embodiments, nevertheless, the heater tube may be part of a dedicated heating circuit, for example an electrically powered heater tube.

Heat generated by the heater tube 112 causes evaporation of the collected water. The evaporator device 120 then preferably comprises at least one mounting device 130 to maintain the heater tube 112 inside the water collecting area 51.

The mounting device 130 preferably comprises a receiving seat 132 and a clip 134 apt to surround the heater tube 112.

The clip 134 is preferably provided with a plurality of aperture 136 apt to receive the heater tube 112 in different positions or different portions of the heater tube 112.

The clip 134 surrounds and grips the heater tube 112 and then inserted into the receiving seat 132. The clip 134 with the heater tube 112 is advantageously maintained into the receiving seat 132 inside the water collecting area 51.

The clip 134 is preferably made of a resilient material, such as EPDM rubber.

Advantageously, assembling operations of the heater tube 112 are simplified during manufacturing process.

Figure 6:
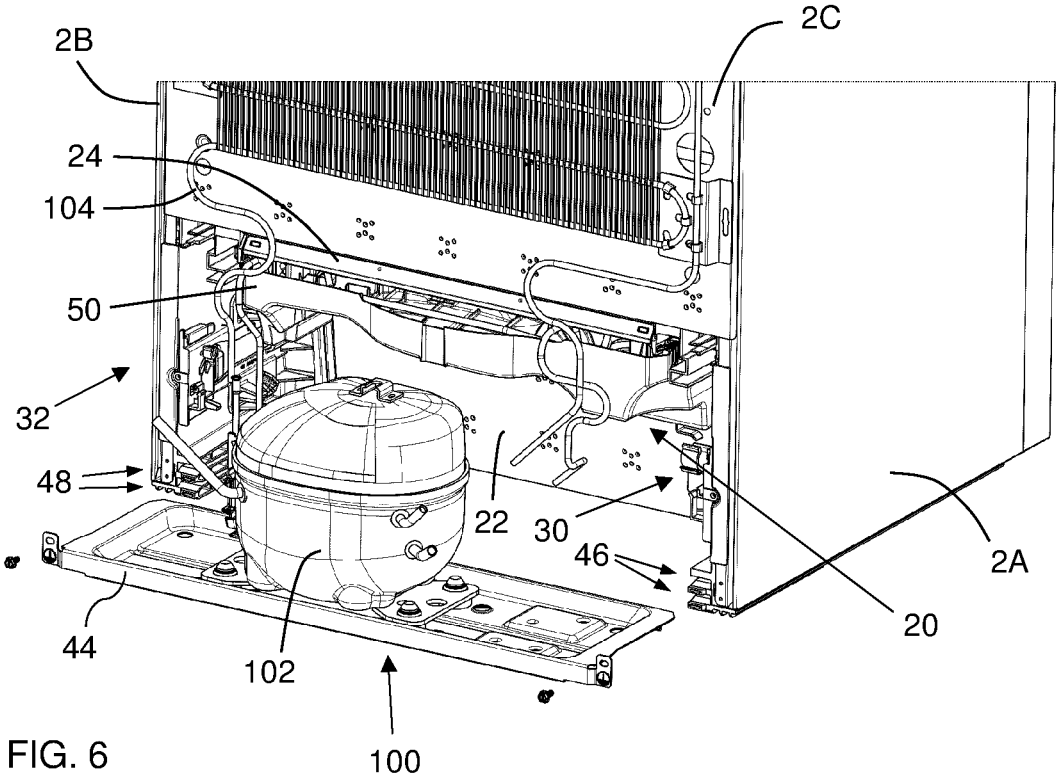
FIG. 6 shows a partial exploded view of FIG. 5.
Figure 7:
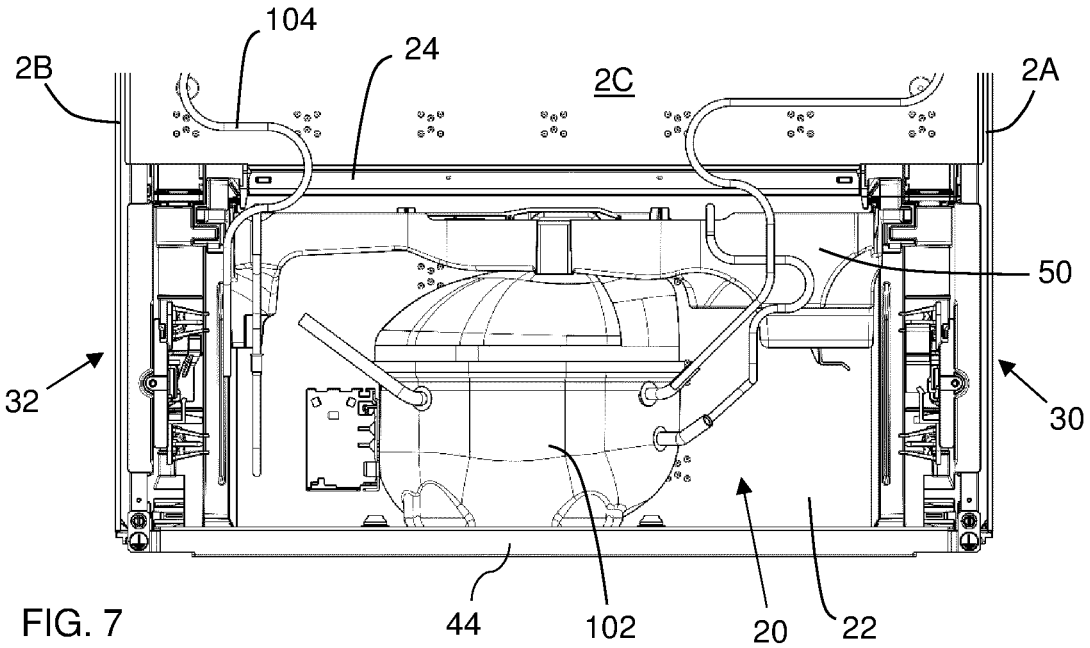
FIG. 7 shows a plan view of FIG. 5.
Figure 8:
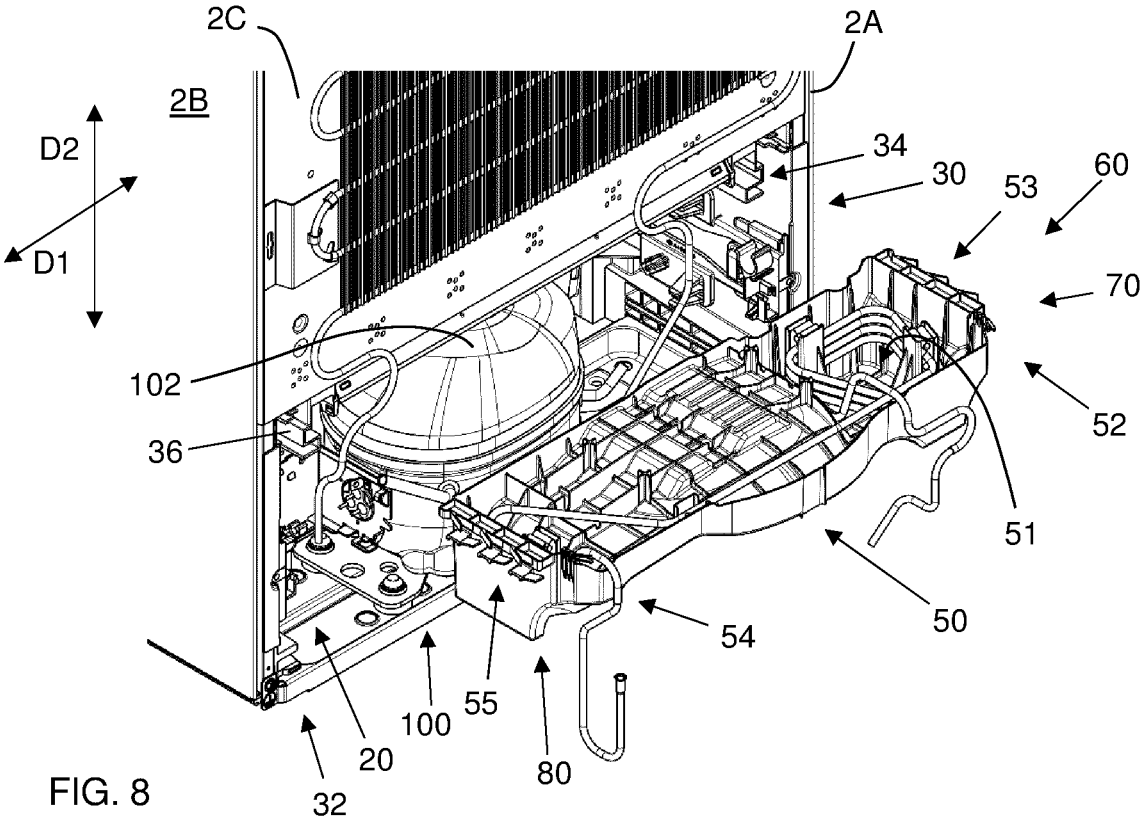
FIG. 8 shows another partial exploded view of FIG. 5.

According to a further aspect of the invention, the supporting element 44 is removably associated to the base supports 30, 32, as it can be appreciated in FIGS. 5 and 6. Preferably, the supporting element 44 is slidingly received by the base supports 30, 32.

Preferably, the first base support 30 comprises at least one slit 46 and the second base support 32 comprises at least one slit 48 apt to slidingly receive lateral sides of the supporting element 44.

According to the preferred embodiment illustrated and described herein, the first base support 30 comprises two slits 46 arranged one above the other and the second base support 32 comprises two slits 48 arranged one above the other.

In different preferred embodiments, the number of superimposed slits may be greater than two.

Figure 18:
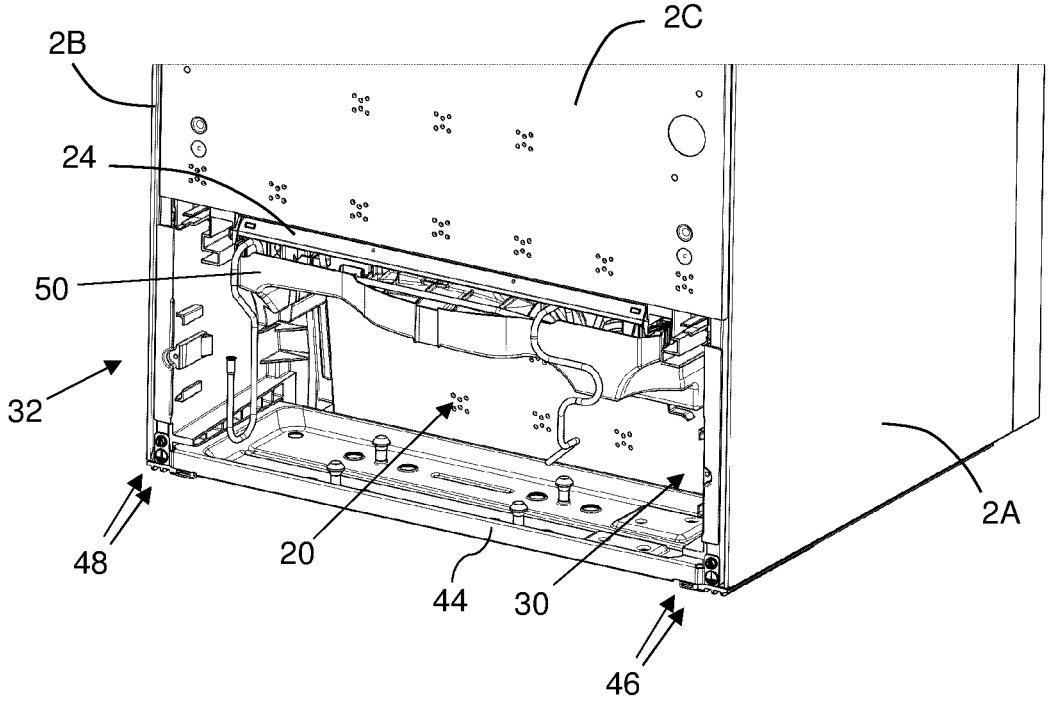
FIG. 18 shows the detail of FIG. 5 in a different operative position.

Advantageously, the supporting element 44 may be arranged in the working chamber 20 at different highs. For example, FIG. 5 shows the supporting element 44 arranged in a low position when inserted in the lower slits 46, 48 inside the working chamber 20 and FIG. 18 shows the supporting element 44 arranged in a high position when inserted in the higher slits 46, 48 inside the working chamber 20.

Advantageously, the supporting element 44 may be arranged in the most proper position according to dimensions of component mounted thereto, in particular according to dimensions of compressor 102.

It has thus been shown that the present invention allows all the set objects to be achieved. In particular, the refrigeration appliance of the invention makes it possible to increase reliability of the appliance compared to known refrigeration appliances.

While the present invention has been described with reference to the particular embodiment shown in the figures, it should be noted that the present invention is not limited to the specific embodiment illustrated and described herein; on the contrary, further variants of the embodiment described herein fall within the scope of the present invention, which is defined in the claims.

The invention claimed is:

1. A refrigeration appliance (1) comprising:

an outer cabinet (2) and an inner liner (6), internal to said outer cabinet (2), defining at least one compartment (10, 12) for the storage of products to be cooled;

a working chamber (20) configured to receive at least one component (102) for the functioning of said appliance (1);

a first lateral base support (30) and a second lateral base support (32) facing said first lateral base support (30), said base supports (30, 32) at least partially laterally delimiting said working chamber (20);

a water collecting tray (50) at least partially delimiting said working chamber (20) from above, said water collecting tray (50) comprising a first end (52) configured to be connected to said first lateral base support (30) and a second end (54) configured to be connected to said second lateral base support (32);

wherein the refrigeration appliance (1) comprises a centering system (60) acting to compensate a relative position between said water collecting tray (50) and said first lateral base support (30) and/or to compensate a relative position between said water collecting tray (50) and said second lateral base support (32) along both a first direction (D1) and a second direction (D2);

wherein the centering system (60) comprises a first centering device (70) that is comprised of at least one first flexible element (72) realized in a first tab (53) of the first end (52) of the tray (50) and configured to abut against a respective first retaining surface (74) of the first base support (30); and wherein the first centering device (70) is also comprised of at least one second flexible element (76) realized in the first end (52) of the tray (50) and configured to abut against a respective second retaining surface (78) of the first base support (30).

2. The appliance (1) according to claim 1, wherein said first direction (D1) is perpendicular to said second direction (D2).

3. The appliance (1) according to claim 1, wherein said first direction (D1) is a horizonal direction and said second direction (D2) is a vertical direction when the appliance (1) is in its standing working position.

4. The appliance (1) according to claim 1, wherein said water collecting tray (50) is removably connected to said first lateral base support (30) and said second lateral base support (32).

5. The appliance (1) according to claim 1, wherein said first centering device (70) comprises:

the least one first flexible element configured to exert a compensating force along said first direction (D1); and the least one second flexible element (76) configured to exert a compensating force along said second direction (D2).

6. The appliance (1) according to claim 1, wherein said centering system (60) comprises:

the first centering device (70) arranged between said first end (52) of said water collecting tray (50) and said first lateral base support (30), said first centering device (70) acting to compensate the relative position between said water collecting tray (50) and said first lateral base support (30) and/or to compensate the relative position between said water collecting tray (50) and said second lateral base support (32) along both said first direction (D1) and said second direction (D2); and a second centering device (80) arranged between said second end (54) of said water collecting tray (50) and said second lateral base support (32), said second centering device (80) acting to compensate the relative position between said water collecting tray (50) and said second lateral base support (32) and/or to compensate the relative position between said water collecting tray (50) and said first lateral base support (30) along both said first direction (D1) and said second direction (D2).

7. The appliance (1) according to claim 6, wherein said second centering device (80) comprises:

at least one first flexible element realized in said second end (54) of said water collecting tray (50) configured to abut against a respective first retaining surface of said second lateral base support (32) to exert a compensating force along said first direction (D1) or at least one first flexible element realized in said second lateral base support (32) configured to abut against a respective first retaining surface of said second end (54) of said water collecting tray (50) to exert a compensating force along said first direction (D1); and at least one second flexible element realized in said second end (54) of said water collecting tray (50) configured to abut against a respective second retaining surface of said second lateral base support (32) to exert a compensating force along said second direction (D2) or at least one second flexible element realized in said second lateral base support (32) configured to abut against a respective second retaining surface of said second end (54) of said water collecting tray (50) to exert a compensating force along said second direction (D2).

8. The appliance (1) according to claim 1, wherein said centering system (60) comprises:

the first centering device (70) arranged between said first end (52) of said water collecting tray (50) and said first lateral base support (30), said first centering device (70) acting to compensate the relative position between said water collecting tray (50) and said first lateral base support (30) and/or to compensate a relative position between said water collecting tray (50) and said second lateral base support (32) along said first direction (D1); and a second centering device (80) arranged between said second end (54) of said water collecting tray (50) and said second lateral base support (32), second centering device (80) acting to compensate the relative position between said water collecting tray (50) and said second lateral base support (32) and/or to compensate a relative position between said water collecting tray (50) and said first lateral base support (30) along said second direction (D2).

9. The appliance (1) according to claim 8, wherein said first centering device (70) comprises:

the at least one first flexible element (72) configured to exert a compensating force along said first direction (D1); and wherein said second centering device (80) comprises:

at least one second flexible element realized in said second end (54) of said water collecting tray (50) configured to abut against a respective second retaining surface of said second lateral base support (32) to exert a compensating force along said second direction (D2) or at least one second flexible element realized in said second lateral base support (32) configured to abut against a respective second retaining surface of said second end (54) of said water collecting tray (50) to exert a compensating force along said second direction (D2).

10. The appliance (1) according to claim 1, wherein the appliance (1) further comprises a first removably fixing device (90) for removably fixing said first end (52) of said water collecting tray (50) to said first lateral base support (30) and/or a second removably fixing device (92) for removably fixing said second end (54) of said water collecting tray (50) to said second lateral base support (32).

11. The appliance (1) according to claim 1, wherein said water collecting tray (50) comprises a water collecting area (51), opening upwards, defined between first end (52) and said second end (54) configured to collect condensed water generated during functioning of the appliance (1).

12. The appliance (1) according to claim 11, wherein the appliance (1) comprises an evaporator device (120) associated with said water collecting area (51), said evaporator device (120) comprising a heater tube (112) for water evaporation and at least one mounting device (130) to maintain said heater tube (112) inside said water collecting area (51).

13. The appliance (1) according to claim 12, wherein said mounting device (130) comprises a receiving seat (132) realized in said water collecting area (51) and a clip (134) configured to surround said heater tube (112) and configured to be inserted into said receiving seat (132).

14. The appliance (1) according to claim 1, wherein the appliance (1) comprises a cross bar (24) connecting said first lateral base support (30) to said second lateral base support (32).

15. The appliance (1) according to claim 14, wherein said first lateral base support (30) and said second lateral base support (32) comprises means for the connection to said cross bar (24), wherein said means comprise a protrusion (40) extending from said first lateral base support (30) and a protrusion (42) extending from said second lateral base support (32), both protrusions (40,42) configured to be connected to respective extremities of said cross bar (24).

16. The appliance (1) according to claim 1, wherein the appliance (1) comprises a supporting element (44) for said at least one component (102), comprising a compressor (102), arranged in a lower part of said working chamber (20), wherein said first lateral base support (30) comprises at least one slit (46) and said second lateral base support (32) comprises at least one slit (48), both slits (46, 48) configured to slidingly receive said supporting element (44).

17. The appliance (1) according to claim 16, wherein said first lateral base support (30) comprises two or more slits (46) arranged one above the other and said second lateral base support (32) comprises two or more slits (48) arranged one above the other so that said supporting element (44) may be slidingly received at different positions.

18. The appliance (1) according to claim 1, wherein said working chamber (20) is arranged on a back side of said appliance (1).

* * * * *